US008257284B2

(12) United States Patent
Gruben et al.

(10) Patent No.: US 8,257,284 B2
(45) Date of Patent: Sep. 4, 2012

(54) TRAINING DEVICE FOR MUSCLE ACTIVATION PATTERNS

(75) Inventors: Kreg G. Gruben, Stoughton, WI (US); Matthew W. Schmidt, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 1494 days.

(21) Appl. No.: 11/231,644

(22) Filed: Sep. 21, 2005

(65) Prior Publication Data

US 2007/0066451 A1 Mar. 22, 2007

(51) Int. Cl.
*A61H 1/00* (2006.01)
*A61B 5/11* (2006.01)

(52) U.S. Cl. ..... 601/33; 601/23; 600/595; 600/587

(58) Field of Classification Search ..... 482/1–8; 600/587, 592, 595; 601/23, 27, 32, 33, 34, 601/35, 36, 40
See application file for complete search history.

(56) References Cited

U.S. PATENT DOCUMENTS

| | | | | |
|---|---|---|---|---|
| 4,463,433 | A | 7/1984 | Hull et al. | |
| 4,604,016 | A * | 8/1986 | Joyce | 414/7 |
| 4,979,733 | A * | 12/1990 | Prud'Hon | 482/4 |
| 5,860,941 | A * | 1/1999 | Saringer et al. | 601/33 |
| 6,061,004 | A * | 5/2000 | Rosenberg | 341/20 |
| 6,315,694 | B1 * | 11/2001 | Osu et al. | 482/8 |
| 6,413,190 | B1 * | 7/2002 | Wood et al. | 482/8 |
| 6,834,436 | B2 * | 12/2004 | Townsend et al. | 33/512 |
| 7,011,665 | B2 * | 3/2006 | Null et al. | 606/99 |
| 2003/0064869 | A1 * | 4/2003 | Reinkensmeyer et al. | 482/100 |
| 2005/0209049 | A1 * | 9/2005 | Shields | 482/8 |
| 2006/0286522 | A1 * | 12/2006 | Ng-Thow-Hing | 434/247 |

* cited by examiner

*Primary Examiner* — Loan Thanh
*Assistant Examiner* — Sandhara Ganesan
(74) *Attorney, Agent, or Firm* — Boyle Fredrickson, S.C.

(57) ABSTRACT

A training device isolates muscular force direction from force magnitude to provide improved feedback to a user over conventional exercise equipment which implicitly conflates magnitude and force direction in producing purely kinematic feedback.

24 Claims, 3 Drawing Sheets

TRAINING DEVICE FOR MUSCLE ACTIVATION PATTERNS

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to a device for training human limb motion and in particular to a device that trains a user to activate muscles to produce a desired direction of force.

Strokes, which occur when blood flow to a region of the brain is obstructed, are a leading cause of severe long-term disability. Studies have shown that while many stroke sufferers have adequate strength at each joint, for example, for walking, the stroke may make it difficult for the sufferer to coordinate this strength for walking.

Rehabilitation efforts for stroke victims often use conventional exercise equipment to retrain correct limb motion. Such exercise equipment, for example, a stationary bicycle, provide resistance along a constrained path of movement that is intended to approximate a desired path of movement that the user is trying to learn.

SUMMARY OF THE INVENTION

The present inventors have recognized that conventional exercise equipment may hide basic errors in muscle activation patterns and/or promote compensating behaviors by the user without addressing the root muscle activation errors. With conventional exercise equipment, so long as the force applied by the user is not perpendicular to the constrained movement of the exercise device, movement of the exercise device may occur even if the direction of force applied is far from optimal. Such devices therefore provide ambiguous and relatively ineffective feedback to the user with respect to the muscle activation pattern the user is trying to learn. Further, because force direction errors may be offset by increased force magnitude, that is, pushing harder, such exercise devices may promote undesirable compensating behavior.

The present invention provides a training device that directly indicates the actual direction of force applied by the user to the device so that the user has instant and immediate feedback as to the success of a particular muscle activation pattern. The direction of the force may be indicated by visual, audio, kinematic means, or any combination of the three, so long as the actual force direction is revealed as substantially distinguishable from force magnitude.

Specifically then, the present invention provides a training device providing a support for a user and a limb-engaging surface receiving a limb of the user when the user is supported by the support. A multi-axis force sensor holds the limb-engaging surface with respect to the user support and communicates with a controller to measure a direction of applied force to the limb-engaging surface in response to instructions to the user to use the limb to apply force in an instructed direction. The controller outputs to the user an indication of the direction of applied force.

Thus it is one object of at least one embodiment of the invention to provide a training system that separates force direction from force magnitude to provide more immediate and accurate feedback to the user.

The indication of direction of applied force may be a deviation between the instructed direction and the direction of applied force.

Thus it is one object of at least one embodiment of the invention to provide the user a simple indication of the user's success in controlling force direction.

Alternatively or in addition, the indication may show an absolute direction of applied force alone or together with an indication of the instructed direction.

Thus it is an object of at least one embodiment of the invention to provide the user with greater information and insight about their application of force to the device.

The controller may output the indication of the direction of applied force via a visual display.

Thus it is an object of at least one embodiment of the invention to provide the user with a flexible multi-dimensional display that can depict the multiple dimensions of force and target direction.

The controller may provide instructions to the user to use the limb to apply force in the instructed direction.

Thus it is an object of at least one embodiment of the invention to allow automatic training regimes in which the controller may prompt the user for certain actions and/or record the results.

The instructions to use the limb to apply force in the instructed direction may be via a graphic on the visual display.

Thus it is an object of at least one embodiment of the invention to provide a simple method of displaying and/or changing the direction of the target force that the user will practice.

The controller may further output to the user an indication of the direction of applied force via a controlled movement of the limb-engaging surface.

Thus it is an object of at least one embodiment of the invention to provide kinematic feedback that may offer a more natural conduit for learning about muscle activation.

The property of movement of the limb-engaging surface may be controlled to be a function of a difference between the instructed direction and the direction of applied force: for example, by controlling resistance to movement or speed of movement as a function of the direction of applied force.

Thus it is an object of at least one embodiment of the invention to provide through a controller a more sophisticated kinematic feedback indicating deviations between an angle of applied force and a target angle than can be obtained in conventional exercise equipment.

The invention may include an input means communicating with the controller for varying the function of the difference in angle between the instructed direction and the direction of applied force used to control movement of the limb-engaging surface.

Thus it is another object of at least one embodiment of the invention to allow gradual adjustment of the training device to require increased accuracy in force application to produce a training device suitable for different stages of rehabilitation.

The controller may further output an indication of a magnitude of applied force on a limb-engaging surface.

Thus it is another object of at least one embodiment of the invention to provide the user with an indication of force magnitude isolated from direction so as to make evident compensating behavior, such as pressing harder in the wrong direction, that should be avoided.

The movement of the limb-engaging surface may be along a track whose orientation may be adjustable to indicate the instructed direction.

Thus it is another object of at least one embodiment of the invention to provide a simple and intuitive indication to the user as to the instructed direction that does not require spatial interpretation of a graphic or the like.

The user support may hold the user in a recumbent position.

Thus it is an object of at least one embodiment of the invention to provide a training device that may work with users who do not have the strength or coordination to walk.

The user support alternatively may hold the user in an upright position.

It is thus another object of at least one embodiment of the invention to provide a training device that may allow the user to adopt a natural orientation for walking.

The limb engagement surface may be a foot stirrup or a hand stirrup.

It is thus another object of at least one embodiment of the invention to provide a system that may work both with arms and legs.

The multi-axis force sensor may detect force in perpendicular axes in a plane, and the plane may be adjustable with respect to the user's support.

It is thus another object of at least one embodiment of the invention to provide a simple method of force detection using conventional force sensors and to provide a system that may be flexibly used for a variety of different muscle activation pattern training.

The center position of the limb-engaging surface may be adjustable with respect to the user's support.

It is thus another object of at least one embodiment of the invention to provide a system that may work with a variety of different joint angles in the limb.

These particular objects and advantages may apply to only some embodiments falling within the claims and thus do not define the scope of the invention.

DETAILED DESCRIPTION OF THE PREFERRED EMBODIMENT

Figure 1:
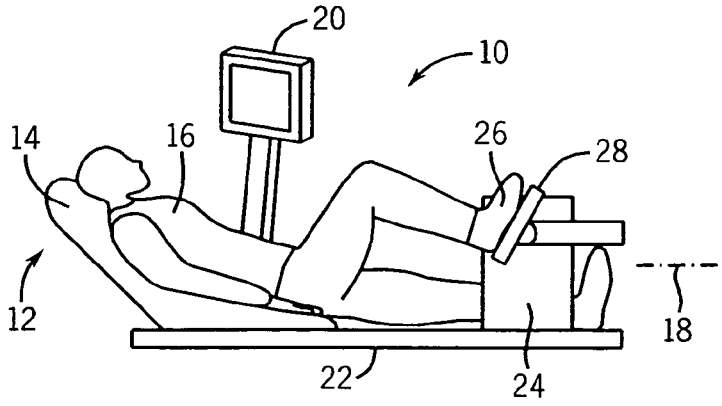
FIG. 1 is a side elevational view of the first embodiment of the present invention allowing operation by a recumbent user and in which a force-sensing foot stirrup is combined with a kinematic feedback actuator to move the user's foot.

Referring now to FIG. 1 in a first embodiment, the training device 10 of the present invention may include a user support 12 providing an adjustable seat 14 supporting a user 16 in a recumbent position, the user's legs extending generally along a longitudinal axis 18.

The adjustable seat 14 may be attached to a longitudinally extending track 22 holding a limb support unit 24 near the user's feet 26. The adjustable seat 14 and/or limb support unit 24 may be adjusted in position along the longitudinally extending track 22 to allow adjustment for different users 16 and for different training applications.

The limb support unit 24 includes a foot stirrup 28 providing a limb-engaging surface that may receive one of the feet 26 and that may be optionally adjusted in height and rotation about vertical and horizontal axes to provide for the desired orientation and position of a center of the stirrup 28 for the desired training session. The limb support unit 24 may be removed and rotated to be used for either or both of the user's feet 26.

A visual display 20, such as a flat panel video display, may be attached to the track 22 and be supported at eye level for viewing by the user 16 while the user 16 is recumbent on the seat 14 with one of the user's feet 26 in the stirrup 28.

Figure 3:
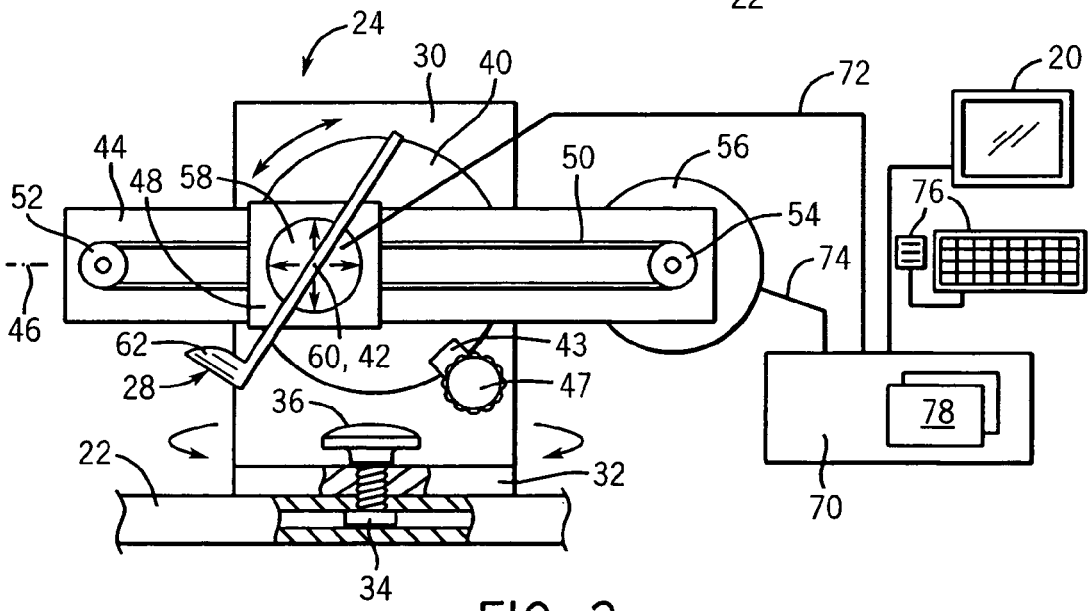
FIG. 3 is a block diagram of the principle components of the present invention showing the combined force-sensing foot stirrup and kinematic feedback actuator of FIG. 1 and the mechanisms allowing orientation of the track of the kinematic feedback device at different angles and different planes of operation.

Referring now to FIG. 3, the limb support unit 24 may include an upwardly extending support plate 30 having a lower horizontal flange 32 attaching to the track 22 for example by a mutually threaded bolt 34 and knob 36 engaging a slot or multiple holes in the track 22 to allow adjustment as described above. The upwardly extending support plate 30 may hold along a vertical face, a turntable 40 so that the turntable 40 may rotate about a horizontal axis 42 with respect to the support plate 30 to be locked at arbitrary angles by a clamp 43 through the use of clamp knob 47.

A linear track 44 extending along a track axis 46 may be attached to the turntable 40 so that rotation of the turntable 40 rotates the track axis 46 within the plane defined by the support plate 30.

The linear track 44 holds a sliding carriage 48 retained by the linear track 44 to slide along axis 46. Movement of the carriage 48 on the linear track 44 is under the control of a belt 50 passing between opposed pulleys 52 and 54 at either end of the track 44, the belt 50 attached at one point along its length to the carriage 48 to move therewith. Pulley 52 may be free turning while pulley 54 may be connected to a servomotor 56 or other similar adjustable control element regulating movement of the belt 50 according to a control signal. The control element may be an electrical device or, for example, a pneumatic or hydraulic actuator and may further be a controllable brake or the like.

The servomotor 56 may include feedback sensors such as a position and/or velocity encoder to provide for various degrees of control feedback loop control as will be understood in the art and as will be described below. Control signals to the servomotor 56 and feedback signals are communicated to and from the servomotor 56 along lines 74.

The carriage 48 supports a multidirectional force sensor 58 providing four-quadrant force measurements using two perpendicular bi-directional linear force sensors, for example strain gauges or the like, oriented in the plane of the support plate 30 to measure a force vector of arbitrary angle and magnitude about a carriage center 60 within the plane of the support plate 30.

The foot stirrup 28 is attached to the force sensor 58 to pivot about the center 60 or alternatively may be locked at a particular angle by conventional means and may include a heel cup 62 and a retaining strap (the latter not shown for clarity). A force exerted by the user's foot onto the stirrup 28 may thus be measured in magnitude and direction by the multi-angle force sensor 58 to produce electrical signals along line 72.

Referring still to FIG. 3, a controller 70, for example a microprocessor having suitable input/output circuits, receive signals from the multi-directional force sensor 58 along line 72, and may provide control signals to servo motor 56 and receives feedback signals along lines 74.

The visual display 20 may be attached to the controller 70 together with input/output devices 76 such as a keyboard, speakers and the like. During operation of the invention, the controller 70 executes a stored program 78 to coordinate operation of the various elements that have been described.

Figure 4:
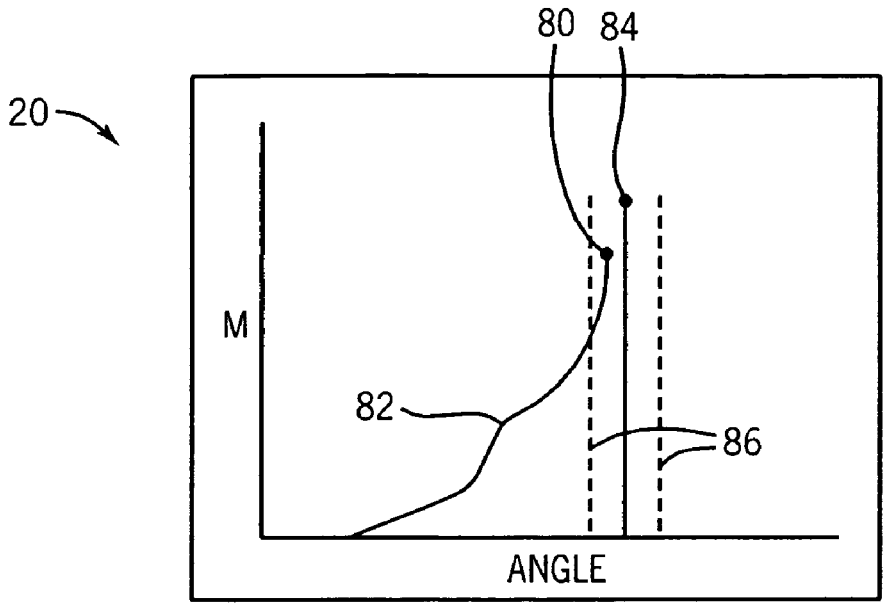
FIG. 4 is a sample display that may be provided to the user showing one method of displaying force direction and magnitude for an actual and instructed force on the stirrup.

Referring now to FIG. 4, in the first embodiment, the controller 70 receives the signals from the multi-dimensional force sensor 58 to deduce a force direction and magnitude of an applied force 80 by the user 16 on the foot stirrup 28. The controller 70 operates in real time to plot the applied force 80 on the visual display 20 as a point on a graph having as its vertical axis force magnitude and as its horizontal axis force angle. The present inventors recognize that the user under rehabilitation or training for muscle activation patterns is facing two distinct tasks: 1) to produce a particular magnitude of force and 2) a to produce a particular direction of force and that most exercise equipment conflates these two dimensions of direction and magnitude into a single manifestation, that is, movement of the exercise device. Importantly, therefore, the feedback to the user 16 provides an unambiguous indication of the direction of applied force distinguishable from the magnitude of the applied force.

The change in the applied force 80 over time may be stored and displayed as a trajectory 82 to provide the user 16 with additional information about the applied force exerted by the user on the stirrup 28. The visual display 20 may also show a desired force and magnitude of a target force 84 as a plotted point on the same graph highlighted as the terminal point of a vertical line of constant angle so as to emphasize the focus on producing the desired angle of force as opposed to a particular magnitude. Target bands 86 of constant angle may be placed on either side of the angle line so as to demonstrate to the user a desired degree of precision.

This visual feedback may be augmented or replaced with audio feedback, for example, announcing quantitative values in a synthesized voice produced by the controller 70 and output through the speakers of the input/output devices 76 or by means of a qualitative tone or the like, all of which may be useful for those with impaired vision.

Figure 5:
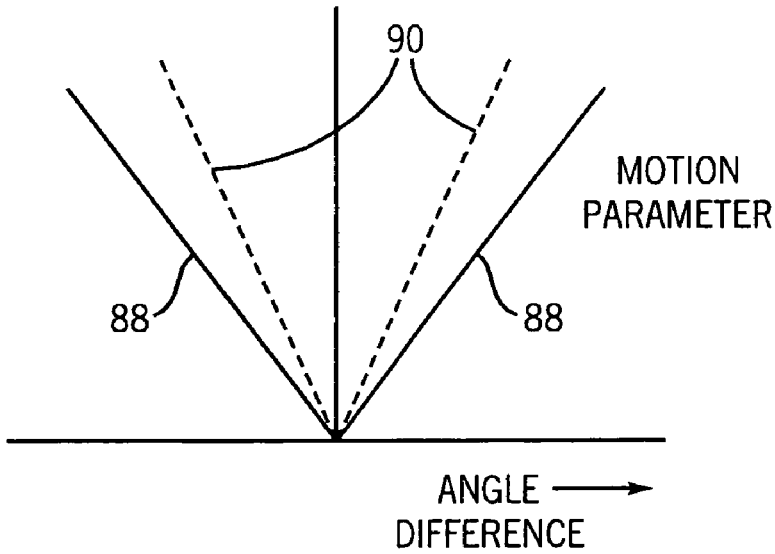
FIG. 5 is a plot of a functional relationship between an angle of force and a motion parameter of the kinematic feedback device illustrating the present invention's ability to change this function as the user's abilities increase.

In addition, the visual and/or audio feedback may be augmented with kinematic feedback in which motion of the carriage 48 is controlled according to the deviation between the applied force 80 and the instructed or target force 84 in angle. As shown in FIG. 5, the controller 70 may implement a function 88 relating a given motion parameter (plotted on the vertical axis of FIG. 5) to an angle difference between applied force 80 and target force 84 (plotted on the horizontal axis of FIG. 5). In the example shown in FIG. 5, the motion parameter of resisting force of movement decreases in magnitude as the different of angle in absolute magnitude decreases. The motion parameter is implemented by feedback control of the servo motor 56 and may be flexibly selected from a variety of parameters including not only resisting force but position, speed, acceleration, and simulated friction or the like.

As the skill of the user increases, the function 88 may be changed to a function 90 requiring increased precision of the angle of application of force for a given change in the motion parameter. Normally the kinematic feedback will augment the visual feedback of the display 20, the kinematic feedback may be used alone as long as angle of applied force can be adequately distinguished independently of magnitude to applied force.

Figure 2:
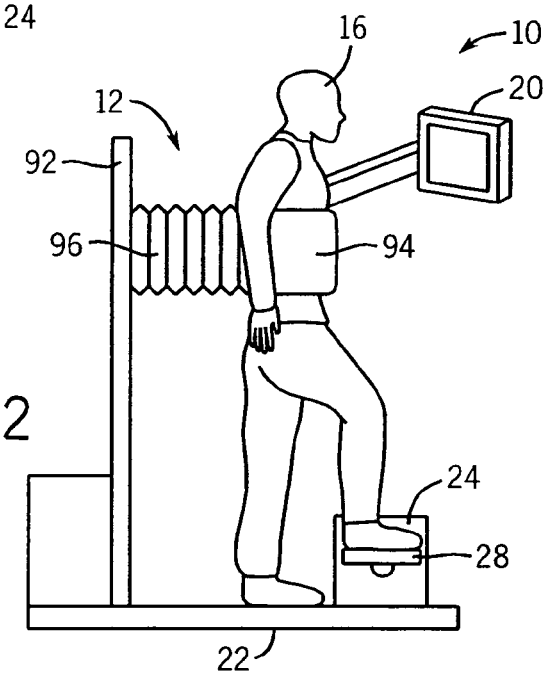
FIG. 2 is a figure similar to that of FIG. 1 showing an embodiment for use with a standing user in which the force-sensing foot stirrup is separated from a kinematic feedback actuator that supports and moves the user's torso.

Referring now to FIG. 2 in an alternative embodiment, the user 16 may stand on the track 22 supported by a torso unit 92 extending upward therefrom and having a belt 94 attached that fits around the torso of the user 16 to support the user 16 in a standing position. An actuator 96 supported by the torso unit 92 communicates with the belt 94 to apply kinematic feedback to the user 16 through the user's torso instead of the user's foot as shown in the embodiment in FIG. 1 such as may more accurately represent the effects of misapplication of force by the user 16 during walking. In this embodiment, the user adopts a more natural attitude, but the user may require greater strength.

The actuator 96 may use a servo motor track system similar to that shown in FIG. 3 or similar hydraulic or pneumatic elements. The foot stirrup 28 in this case is attached to the multi-directional force sensor 58 which attaches directly to support plate 30 without the intervening track 44.

Figure 6:
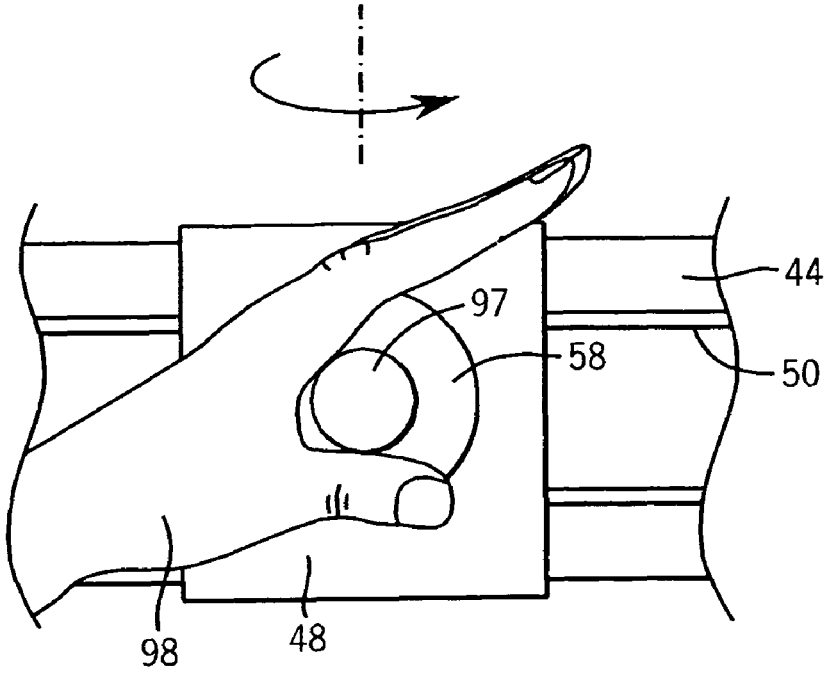
FIG. 6 is a fragmentary view of a hand stirrup that may be used in place of the foot stirrup of FIG. 1 for use in training arm movement.

Referring now to FIG. 6, in an alternative embodiment, the carriage 48 may support a hand stirrup 97 instead of the foot stirrup 28 to be used with a user's hand 98 for training the arm muscles. Again the hand stirrup 97 is connected to a multi-directional force sensor 58 which connects it to the carriage 48 to provide for a possible kinematic feedback. In this embodiment, the height of the hand stirrup 97 with respect to the track will be increased. The hand stirrup 97 may be used in either the embodiments of FIG. 1 or FIG. 2.

Figure 7:
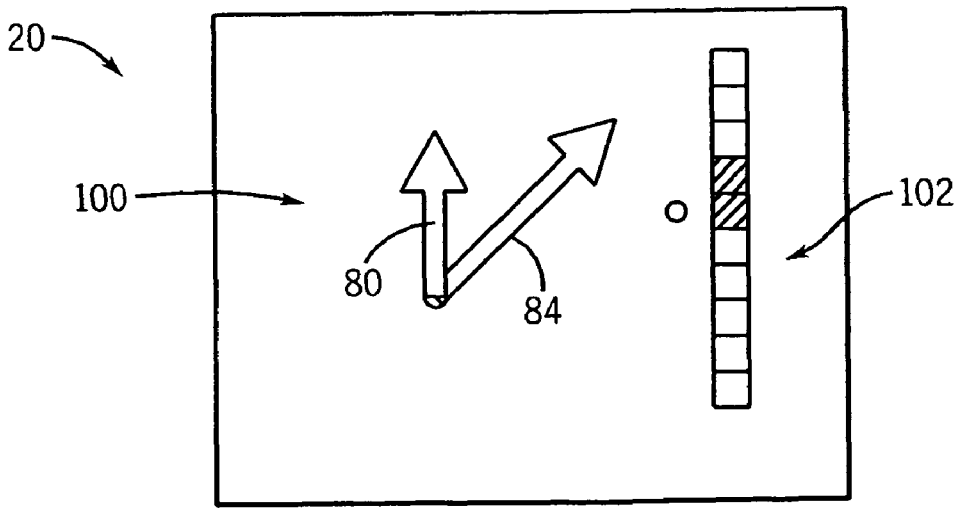
FIG. 7 is a figure similar to that of FIG. 4 showing an alternative display in which force and instructed force are depicted as vectors and showing a bar chart indicating a difference in angle.

Referring now to FIG. 7, it will be understood that a variety of different visual feedback graphics can be produced including, for example, a vector graphic 100 in which the applied force 80 and the target force 84 are depicted as arrows having a length proportional to magnitude and an angle proportional to the angle of the applied force. Alternatively, a difference representation 102 may be created in which the difference in angle between the applied force 80 and the target force 84 is represented, in this case as a bar chart that may range between positive and negative values. Audio equivalents of this difference may also be produced.

While the present invention is contemplated for use in rehabilitation of stroke victims, it may be used for other neurological or muscular problems. In addition, the present invention may find use in general athletic training to provide a method of directing athletes to more efficient muscular coordination. It is specifically intended that the present invention not be limited to the embodiments and illustrations contained herein, but include modified forms of those embodiments including portions of the embodiments and combinations of elements of different embodiments as come within the scope of the following claims.

We Claim:

1. A training apparatus comprising:

a support for supporting a user;

a limb-engaging surface receiving a limb of the user when the user is supported in the user support;

a multi-axis force sensor holding the limb engaging surface with respect to the user support; and a controller communicating with the multi-axis force sensor to measure a direction of applied force over a range of different angles applied by the user on the limb-engaging surface in response to instruction to the user to use the limb to apply force in an instructed direction, the controller outputting to the user an indication of the direction of applied force.

2. The apparatus of claim 1 wherein the indication output to the user is a difference between the instructed direction and the direction of the applied force.

3. The apparatus of claim 1 wherein the controller outputs the indication of the direction of applied force via a visual display.

4. The apparatus of claim 3 wherein the visual display shows the instructed direction and the direction of applied force.

5. The apparatus of claim 4 wherein the controller provides instruction to use the limb to apply force in an instructed direction.

6. The apparatus of claim 3 wherein the controller further outputs to the user an indication of deviation between the instructed direction and of the direction of applied force via a controlled movement of the limb-engaging surface.

7. The apparatus of claim 6 wherein a property of movement of the limb-engaging surface is controlled to be a function of a difference between the instructed direction and the direction of applied force.

8. The apparatus of claim 7 wherein the property is resistance to movement.

9. The apparatus of claim 7 wherein the property is speed of movement.

10. The apparatus of claim 7 further including an input means communicating with the controller for varying a function of a difference in angle between the instructed direction and the direction of applied force to increase a required user accuracy.

11. The apparatus of claim 1 wherein the controller further outputs an indication of a magnitude of applied force on the limb-engaging surface.

12. The apparatus of claim 1 wherein the controller further outputs to the user an indication of deviation between the instructed force direction and of the direction of applied force via a controlled movement of the limb-engaging surface.

13. The apparatus of claim 12 wherein a property of movement of the limb-engaging surface is controlled to be a function of a difference in angle between the instructed direction and the direction of applied force.

14. The apparatus of claim 13 wherein the property is resistance to movement.

15. The apparatus of claim 13 wherein the property is speed of movement.

16. The apparatus of claim 13 further including an input means for varying the function of the difference in angle between the instructed direction and the direction of applied force to increase a required user accuracy.

17. The apparatus of claim 12 wherein the movement is along a track whose orientation is adjusted to indicate the instructed direction.

18. The apparatus of claim 1 wherein the user support holds the user in a recumbent position.

19. The apparatus of claim 1 wherein the user support holds the user in an upright position.

20. The apparatus of claim 1 wherein the multi-axis force sensor detects force in perpendicular axes in a plane.

21. The apparatus of claim 1 wherein the limb-engaging surface is a foot stirrup.

22. The apparatus of claim 1 wherein the limb-engaging surface is a hand stirrup.

23. The apparatus of claim 22 wherein an angle of the plane with respect to the user support is adjustable.

24. The apparatus of claim 1 wherein a center position of the limb-engaging surface is adjustable with respect to the user support.

* * * * *